US009837040B2

(12) United States Patent
Moon et al.

(10) Patent No.: US 9,837,040 B2
(45) Date of Patent: Dec. 5, 2017

(54) MOBILE DEVICE INCLUDING A DISPLAY DEVICE AND A METHOD OF OPERATING THE MOBILE DEVICE

(71) Applicant: SAMSUNG ELECTRONICS CO., LTD., Suwon-si, Gyeonggi-Do (KR)

(72) Inventors: Young-Bae Moon, Yongin-si (KR); Jihyun Lee, Seoul (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 116 days.

(21) Appl. No.: 14/856,913

(22) Filed: Sep. 17, 2015

(65) Prior Publication Data

US 2016/0098959 A1 Apr. 7, 2016

(30) Foreign Application Priority Data

Oct. 6, 2014 (KR) ..... 10-2014-0134126

(51) Int. Cl.

| | |
|---|---|
| ***G09G 3/36*** | (2006.01) |
| ***G09G 3/32*** | (2016.01) |
| ***G09G 3/20*** | (2006.01) |
| ***G09G 5/10*** | (2006.01) |

(52) U.S. Cl.

CPC ..... *G09G 3/3696* (2013.01); *G09G 3/2092* (2013.01); *G09G 2310/08* (2013.01); *G09G 2320/0242* (2013.01); *G09G 2330/028* (2013.01); *G09G 2340/0435* (2013.01)

(58) Field of Classification Search

CPC ..... G09G 3/20–3/3688

See application file for complete search history.

(56) References Cited

U.S. PATENT DOCUMENTS

| | | | | |
|---|---|---|---|---|
| 5,864,336 | A * | 1/1999 | Yano | G06F 3/147 345/536 |
| 7,098,904 | B2 | 8/2006 | Kato | |
| 7,129,786 | B2 | 10/2006 | Kim et al. | |
| 7,317,440 | B2 | 1/2008 | Chung | |
| 8,471,794 | B2 | 6/2013 | Nakahira et al. | |

(Continued)

FOREIGN PATENT DOCUMENTS

| | | |
|---|---|---|
| KR | 1020040054427 | 6/2004 |
| KR | 1020060077200 | 7/2006 |
| KR | 1020090071861 | 7/2009 |

*Primary Examiner* — Lin Li

(74) *Attorney, Agent, or Firm* — F. Chau & Associates, LLC

(57) ABSTRACT

A display driver includes a gamma voltage generation unit, a decoder, and a plurality of source amplifiers. The gamma voltage generation unit generates gamma reference voltages. The decoder transforms pixel data corresponding to received image information into data voltages using the gamma reference voltages. The plurality of source amplifiers outputs the data voltages to a display panel. The gamma voltage generation unit includes a first amplifier receiving a reference voltage and a voltage divider including a plurality of resistors and at least one first switch. The at least one first switch turns on or turns off a first connection between an output node of the first amplifier and the plurality of resistors depending on an operation mode. The voltage divider generates at least one first gamma reference voltage among the gamma reference voltages based on an output voltage of the first amplifier.

12 Claims, 12 Drawing Sheets

(56) References Cited

U.S. PATENT DOCUMENTS

| | | | | |
|---|---|---|---|---|
| 2004/0056868 | A1* | 3/2004 | Kato | G09G 3/3688 345/600 |
| 2005/0168416 | A1* | 8/2005 | Hashimoto | G09G 3/3233 345/76 |
| 2005/0195652 | A1* | 9/2005 | Maki | G09G 3/3655 365/185.11 |
| 2006/0071893 | A1 | 4/2006 | Nishina et al. | |
| 2007/0040855 | A1* | 2/2007 | Kato | G09G 3/3688 345/690 |
| 2008/0218500 | A1 | 9/2008 | Akai et al. | |
| 2008/0266276 | A1* | 10/2008 | Choi | G09G 3/3685 345/204 |
| 2008/0303750 | A1* | 12/2008 | Ludden | G09G 3/2092 345/55 |
| 2009/0213042 | A1* | 8/2009 | Hagino | G09G 3/2011 345/55 |
| 2010/0165006 | A1 | 7/2010 | Son | |
| 2012/0206506 | A1* | 8/2012 | Kim | G09G 3/20 345/690 |
| 2013/0271507 | A1* | 10/2013 | Kim | G09G 3/3291 345/690 |
| 2014/0085349 | A1* | 3/2014 | Shiibayashi | G09G 5/10 345/690 |
| 2014/0232755 | A1* | 8/2014 | Wang | G09G 5/10 345/690 |

* cited by examiner

MOBILE DEVICE INCLUDING A DISPLAY DEVICE AND A METHOD OF OPERATING THE MOBILE DEVICE

CROSS-REFERENCE TO RELATED APPLICATION

This U.S. non-provisional patent application claims priority under 35 U.S.C. §119 to Korean Patent Application No. 10-2014-0134126, filed on Oct. 6, 2014, in the Korean Intellectual Property Office (KIPO), the disclosure of which is incorporated by reference herein in its entirety.

TECHNICAL FIELD

The present inventive concept relates to a mobile device, and more particularly to, a mobile device including a display device and a method of operating the mobile device.

DISCUSSION OF THE RELATED ART

As a mobile device such as a smart phone, or the like, is developed, a method of operating the mobile device in a low power operation mode may be employed to reduce power consumption.

SUMMARY

According to an embodiment of the present inventive concept, a display driver is provided. The display driver includes a gamma voltage generation unit, a decoder, and a plurality of source amplifiers. The gamma voltage generation unit is configured to generate a plurality of gamma reference voltages having different voltage levels from one another in response to a gamma enable signal. The decoder is configured to transform pixel data corresponding to received image information into data voltages using the plurality of gamma reference voltages. The plurality of source amplifiers is configured to output the data voltages to a display panel. The gamma voltage generation unit includes a first amplifier and a voltage divider. The first amplifier is configured to receive a first reference voltage. The voltage divider includes a plurality of resistors and a plurality of switches including at least one first switch. The at least one first switch is connected to the first amplifier to turn on or turn off a first connection between an output node of the first amplifier and the plurality of resistors depending on an operation mode. The voltage divider generates at least one first gamma reference voltage among the plurality of gamma reference voltages based on an output voltage of the first amplifier.

The gamma voltage generation unit may further include a second amplifier configured to receive a second reference voltage. The plurality of switches may further include at least one second switch. The at least one second switch may be connected to the second amplifier to turn on or turn off a second connection between an output node of the second amplifier and the plurality of resistors depending on the operation mode. The voltage divider may generate at least one second gamma reference voltage among the plurality of gamma reference voltages based on an output voltage of the second amplifier.

The gamma voltage generation unit may further include a third amplifier configured to receive a third reference voltage. The third amplifier may be connected to the plurality of resistors. The voltage divider may generate at least one third gamma reference voltage among the gamma reference voltages based on an output voltage of the third amplifier.

The display driver may further include a control logic. When the operation mode is a first low power mode, the control logic may be configured to control a level of a bias voltage applied to at least one of the source amplifiers.

When the operation mode is a second low power mode, the first and second connections may be turned off using the at least one first switch and the at least one second switch, and the display driver may operate based on the output voltages of the first amplifier and the second amplifier.

When the operation mode is a third low power mode, the third amplifier except for the first and second amplifiers may be turned off.

When the operation mode is a low power mode, an operation frequency of the display driver may be below a reference frequency.

The first through third reference voltages may be different from one another.

When the operation mode is a low power mode, the first and second connections may be turned on using the at least one first switch and the at least one second switch, and the display driver may operate based on the plurality of gamma reference voltages.

According to an exemplary embodiment of the present inventive concept, a display device is provided. The display device includes a display panel and a display driver. The display panel includes a plurality of pixels disposed where source lines and gate lines cross one another. The display driver is configured to provide data voltages generated based on received image information to the display panel. The display driver includes a gamma voltage generation unit, a decoder, and a plurality of source amplifiers. The gamma voltage generation unit is configured to generate a plurality of gamma reference voltages having different voltage levels from one another in response to a gamma enable signal. The decoder is configured to transform pixel data corresponding to the image information into the data voltages using the plurality of gamma reference voltages. The plurality of source amplifiers is configured to output the data voltages to the display panel. The gamma voltage generation unit includes at least one amplifier and a voltage divider. The at least one amplifier is configured to receive a reference voltage. The voltage divider includes a plurality of resistors and a plurality of switches including at least one first switch. The voltage divider generates the plurality of gamma reference voltages based on an output voltage of the at least one amplifier. The at least one first switch electrically cuts off an output voltage of a first amplifier selected among the at least one amplifier from the plurality of resistors depending on an operation mode.

The voltage divider may further include at least one second switch. The at least one second switch may be configured to electrically cut off an output voltage of a second amplifier selected among the at least one amplifier from the plurality of resistors, depending on the operation mode.

The display device may further include a timing controller and a gate driver. When the operation mode is a first low power mode, the timing controller may be configured to receive the image information to provide the received image information to the display driver, and to reduce an operation frequency of the display device below a reference frequency. The gate driver may be configured to drive the gate lines.

The display device may further include a control logic. The control logic may be configured to control a level of a bias voltage applied to at least one of the source amplifiers when the operation mode is a second low power mode.

When the operation mode is a third low power mode, the at least one first switch and the at least one second switch may electrically cut off the output voltages of the first and second amplifiers.

When the operation mode is a fourth low power mode, at least one third amplifier except for the first and second amplifiers among the at least one amplifier may be turned off.

When the operation mode is a fifth low power mode, the timing controller may delay a timing at which a gate control signal is enabled by a reference time.

According to an exemplary embodiment of the present inventive concept, a method of driving a display device is provided. The method includes reducing an operation frequency of the display device when an operation mode is a first low power mode and reducing a bias voltage applied to a source amplifier providing data voltages to a display panel when the operation mode is a second low power mode.

The method may further include selectively turning on at least one amplifier among a plurality of amplifiers in a gamma voltage generation unit providing gamma reference voltages when the operation mode is a third low power mode.

The method may further include delaying a gate timing at which a gate clock signal is enabled when the operation mode is a fourth low power mode.

The operation mode may be indicated by a host.

BRIEF DESCRIPTION OF THE FIGURES

The above and other features of the present inventive concept will become more apparent by describing exemplary embodiments of thereof with reference to the following figures, in which.

DETAILED DESCRIPTION OF THE EMBODIMENTS

Figure 1:
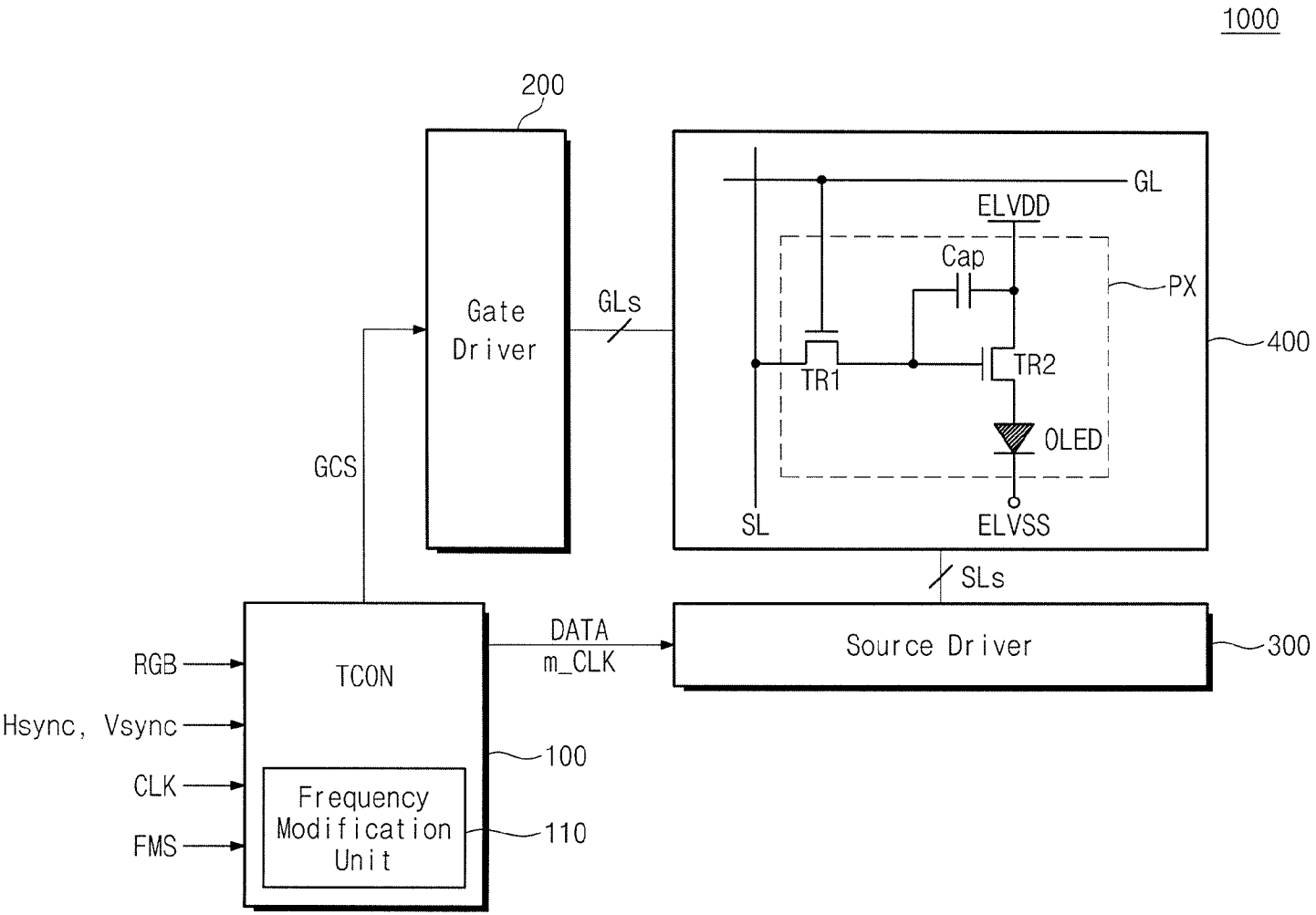
FIG. 1 is a block diagram illustrating a device according to an exemplary embodiment of the present inventive concept.

Hereinafter, exemplary embodiments of present inventive concept will now be described more in detail with reference to the accompanying drawings. This present inventive concept may, however, be embodied in various forms, and should not be construed as limited to the exemplary embodiments set forth herein. In the drawings, the size and relative sizes of layers and regions may be exaggerated for clarity. Like reference numerals may refer to like elements throughout the specification and drawings. All the elements throughout the specification and drawings may be circuits.

It will be understood that when an element is referred to as being "connected" or "coupled" to another element, it can be directly connected or coupled to the other element or intervening elements may be present. As used herein, the term "and/or" includes any and all combinations of one or more of the associated listed items.

As used herein, the singular forms "a", "an" and "the" are intended to include the plural forms as well, unless the context clearly indicates otherwise.

FIG. 1 is a block diagram illustrating a device 1000 according to an exemplary embodiment of the present inventive concept. Referring to FIG. 1, the device 1000 may include a timing controller 100, a gate driver 200, a source driver 300, and a display panel 400.

The timing controller 100 can receive image information RGB and a control signal from the outside thereof. The control signal may include a vertical synchronizing signal Vsync, a horizontal synchronizing signal Hsync, a clock signal CLK, etc. The timing controller 100 changes a format of the image information RGB to accord with specification requirements of the source driver 300 to generate serialized data DATA and transmits the generated serialized data DATA to the source driver 300. The timing controller 100 can transmit the serialized data DATA and the clock signal CLK of an embedded clock form at the same time through a single channel. In an exemplary embodiment of the present inventive concept, the serialized data DATA and the clock signal CLK may be transmitted through separate channels, respectively.

The timing controller 100 generates a gate control signal GCS based on the control signal, and transmits the generated gate control signal GCS to the gate driver 200. The gate control signal GCS may include a signal that indicates a start of a scanning, a signal that controls a period of a gate-on voltage, and a signal that controls a duration time of the gate-on voltage.

According to an exemplary embodiment of the present inventive concept, the timing controller 100 can control an operation frequency of the device 1000 depending on an operation mode of the device 1000. When a request (e.g., a frequency modification signal (FMS)) for a low power mode (e.g., active-matrix organic light-emitting diode low power mode (ALPM)) is received from a host, the timing controller 100 can reduce the operation frequency of the device 1000 below a reference frequency. When the device 1000 operates at 60 Hz in a normal power mode, the device 1000 can operate at 30 Hz, 15 Hz, etc. in a low power mode. Thus, the timing controller 100 can transmit a clock signal m_CLK having a modified frequency to the source driver 300. A modification of the operation frequency of the device 1000 may be performed in a frequency modification unit 110 in the timing controller 100.

The gate driver 200 can drive gate lines GLs in response to the gate control signal GCS so that pixel data DATA may be sequentially output to the display panel 400.

According to an exemplary embodiment of the present inventive concept, the gate driver 200 can receive the gate control signal GCS to control a time at which the gate line is driven. For example, a settling time of an output of a source amplifier of the source driver 300 can be secured by delaying a gate timing in the low power mode operation compared with that in the normal power mode. Accordingly, a bias current of the source amplifier may be reduced and thus, power consumption of the device 1000 may be reduced.

The source driver 300 can output a gray scale voltage, which corresponds to the data DATA received from the timing controller 100, to the display panel 400 through source lines SLs. In the low power mode of the device 1000, the source driver 300 can control a bias current of the source amplifier, which outputs a data signal (e.g., a gray scale voltage), of the source driver 300. Accordingly, the power consumption of the device 1000 may be reduced by reducing the bias current of the source amplifier.

The display panel 400 may include pixels PX arranged where the gate lines GLs and the source lines SLs cross one another. The display panel 400 may be an organic light-emitting diode (OLED), a liquid crystal display (LCD) panel, an electrophoretic display panel, an electrowetting display panel, a plasma display panel PDP, etc. Although the display panel is described as an active matrix organic light-emitting diode (AMOLED) as an example, however, the present inventive concept is not limited thereto.

Each pixel PX of the display panel 400 may include a first transistor TR1, a second transistor TR2, a capacitor Cap, and an organic light-emitting diode (OLED).

The first transistor TR1 can output the data signal received through the source line SL in response to a gate signal received through the gate line GL. The capacitor Cap can charge charges corresponding to a difference between a first power supply voltage ELVDD and a voltage that corresponds to the data signal output from the first transistor TR1. The second transistor TR2 is turned on by the charges charged in the capacitor Cap. The second transistor TR2 can control a driving current that flows through the OLED. A turn-on period of the second transistor TR2 is determined depending on an amount of charges charged in the capacitor Cap.

The OLED may include a first electrode connected to the second transistor TR2 and a second electrode connected to a second power supply voltage ELVSS. The OLED may include a first common layer, an organic light-emitting pattern, and a second common layer that are disposed between the first electrode and the second electrode. The OLED can emit light during the turn-on period of the second transistor TR2. A color of light generated from the OLED may be determined by a material that forms an organic light-emitting pattern. For example, the color of light generated from the OLED may be a red color, a green color, a blue color, a white color, or the like.

Figure 2:
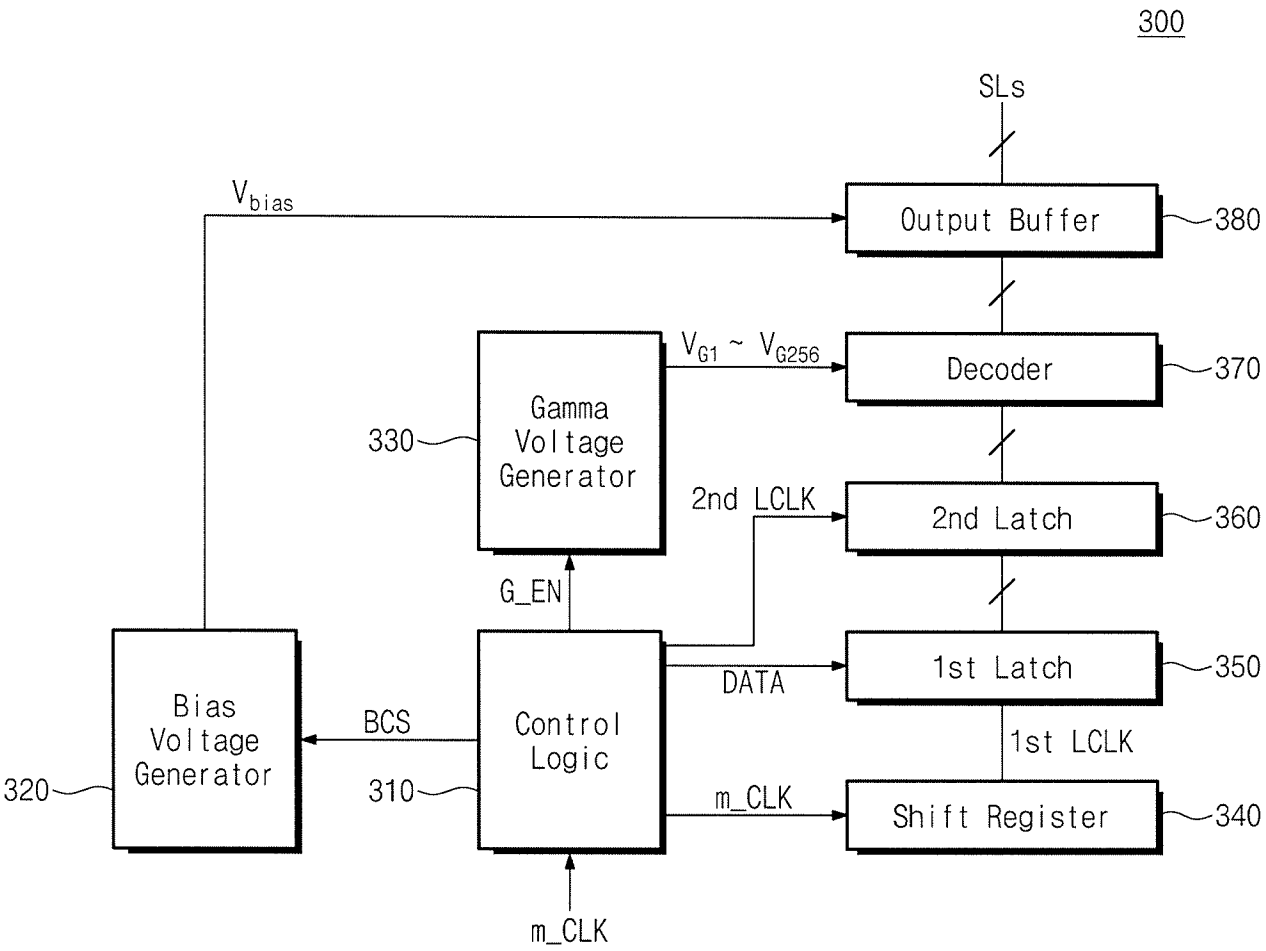
FIG. 2 is a block diagram illustrating a source driver according to an exemplary embodiment of the present inventive concept.

FIG. 2 is a block diagram illustrating a source driver 300 according to an exemplary embodiment of the present inventive concept. Referring to FIG. 2, the source driver 300 may include a control logic 310, a bias voltage generation unit 320, a gamma voltage generation unit 330, a shift register 340, a first latch 350, a second latch 360, a decoder 370, and an output buffer 380.

The control logic 310 can receive a clock signal m_CLK from the timing controller 100. The clock signal m_CLK has a modified operation frequency according to a request for a low power mode operation received from a host. The control logic 310 can generate various signals based on the clock signal m_CLK having the modified operation frequency.

The control logic 310 can generate a bias control signal BCS controlling a level of a bias voltage Vbias that is applied to source amplifiers. The source amplifiers may constitute the output buffer 380. For example, when a low power mode operation is requested from a host, the control logic 310 can reduce a level of the bias voltage Vbias. The control logic 310 can operate the device 1000 so that the device 1000 is embodied in a full-color mode and the power consumption of the device 1000 may be reduced. In the full-color mode, image data may be output to the display panel 400 using all gamma reference voltages $VG_1$~$VG_{256}$ generated by the gamma voltage generation unit 330.

The control logic 310 can generate a gamma enable signal G_EN. The gamma enable signal G_EN controls the gamma voltage generation unit 330 so that a plurality of gamma reference voltages $VG_1$~$VG_{256}$ are generated. The gamma reference voltages $V_{G1}$~$V_{G256}$ may be used to transform data DATA into a data voltage (e.g., a gray scale voltage).

The control logic 310 can change the serialized data DATA received from the timing controller 100 into the parallelized data DATA. The control logic 310 can transmit the parallelized data DATA to the first latch 350.

According to an exemplary embodiment of the present inventive concept, in a low power mode operation, the control logic 310 can control a part of a plurality of amplifiers (e.g., at least one amplifier selected from a plurality of amplifiers) included in the gamma voltage generation unit 330 to be turned on, and thus, the control logic 310 can transform the data DATA into a data voltage using a part (e.g., $V_{G1}$ and $V_{G256}$) of the gamma reference voltages $V_{G1}$~$V_{G256}$. For example, the part of the gamma reference voltages $V_{G1}$~$V_{G256}$ may be at least one gamma reference voltage selected from the gamma reference voltages $V_{G1}$~$V_{G256}$. For example, the control logic 310 can operate the device 1000 in, for example, an 8-color mode which is not the full-color mode.

The bias voltage generation unit 320 can generate bias voltages Vbias having various voltage levels in response to the bias control signal BCS.

The gamma voltage generation unit 330 can receive the gamma enable signal G_EN to generate the gamma reference voltages $V_{G1}$~$V_{G256}$ having various voltage levels. The gamma voltage generation unit 330 can turn on a part of the amplifiers in the gamma voltage generation unit 330 so that a part of the gamma reference voltages $V_{G1}$~$V_{G256}$ is selected in a low power mode operation.

The shift register 340 can generate a first latch clock signal 1st LCLK on the basis of the clock signal m_CLK. The first latch clock signal 1st LCLK can control a timing at which pixel data DATA stored in the second latch 360 through the first latch 350 is output to the display panel 400.

The first latch 350 can temporarily store the parallelized data DATA received from the control logic 310. The parallelized data DATA can be sequentially stored in the first latch 350 to fit a position in which the parallelized data DATA will be output to the display panel 400. The first latch 350 can transmit data, which is latched at a desired time according to a control of the first latch clock signal 1st LCLK received from the shift register 340, to the second latch 360.

The second latch 360 can be inputted with pixel data DATA stored in the first latch 350. The second latch 360 can be inputted with a second latch signal 2nd LCLK from the control logic 310. The second latch 360 transmits the pixel data DATA stored therein to the decoder 370.

The decoder 370 can transform the pixel data DATA received from the second latch 360 into a data voltage (e.g., a gray scale voltage) using the gamma reference voltages $V_{G1}$~$V_{G256}$ received from the gamma voltage generation unit 330. In an exemplary embodiment of the present inventive concept, the decoder 370 can change the pixel data DATA into the data voltage using a part (e.g., $V_{G1}$ and $V_{G256}$) of the gamma reference voltages $V_{G1}$~$V_{G256}$ in a low power mode operation.

The output buffer 380 may include a plurality of source amplifiers. Each source amplifier can be inputted with the data voltage received from the decoder 370 to output the data voltage to the display panel 400. Red, green, and blue data can be sequentially output through channels connected to the output buffer 380.

In a low power mode operation, the power consumption of the device 1000 can be reduced in various ways. For example, the power consumption of the device 1000 can be reduced by reducing an operation frequency of the device 1000, reducing a level of a bias voltage applied to at least one of the plurality of source amplifier, or turning on a part of the plurality of source amplifiers included in the gamma voltage generation unit 330.

Figure 3:
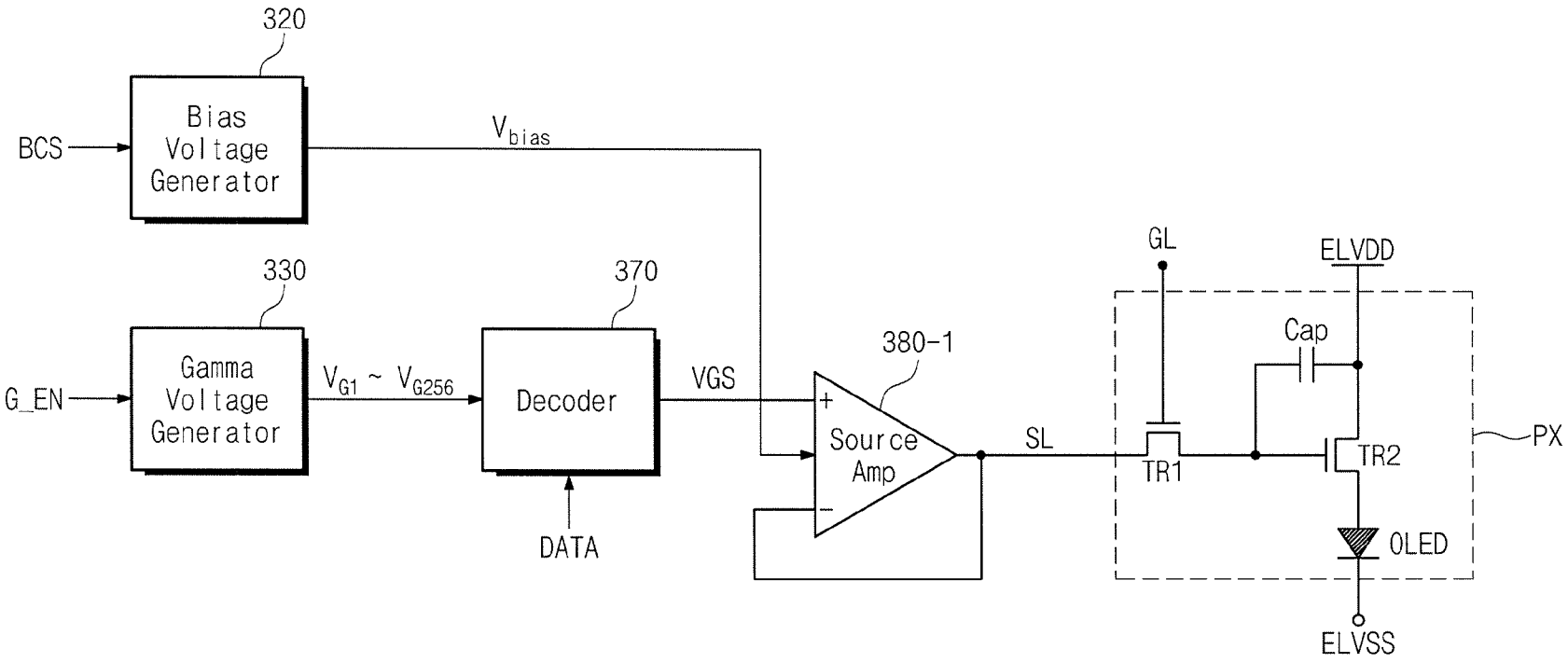
FIG. 3 is a block diagram illustrating a part of the source driver of FIG. 2 according to an exemplary embodiment of the present inventive concept.

FIG. 3 is a block diagram illustrating a part of the source driver of FIG. 2 according to an exemplary embodiment of the present inventive concept. For convenience of description, although only one decoder 370 for driving one pixel PX and one source amplifier 380-1 included in the output buffer 380 are illustrated in FIG. 3, the present inventive concept is not limited thereto.

The source amplifier 380-1 can receive a gray scale voltage $V_{GS}$ from the decoder 370 and drive the gray scale voltage $V_{GS}$ according to a level of a bias voltage Vbias applied to the source amplifier 380-1. The driven gray scale voltage $V_{GS}$ may be output to a pixel PX through a source line SL. The source amplifier 380-1 may consume a relatively large amount of current to drive the pixel PX. This may be because a turn-on period of the pixel PX is proportional to an amount of charges charged in a capacitor Cap. According to an exemplary embodiment of the present inventive concept, an operation frequency of the device 1000 may be reduced in a low power mode and thus, the power consumption thereof may be reduced.

Figure 4:
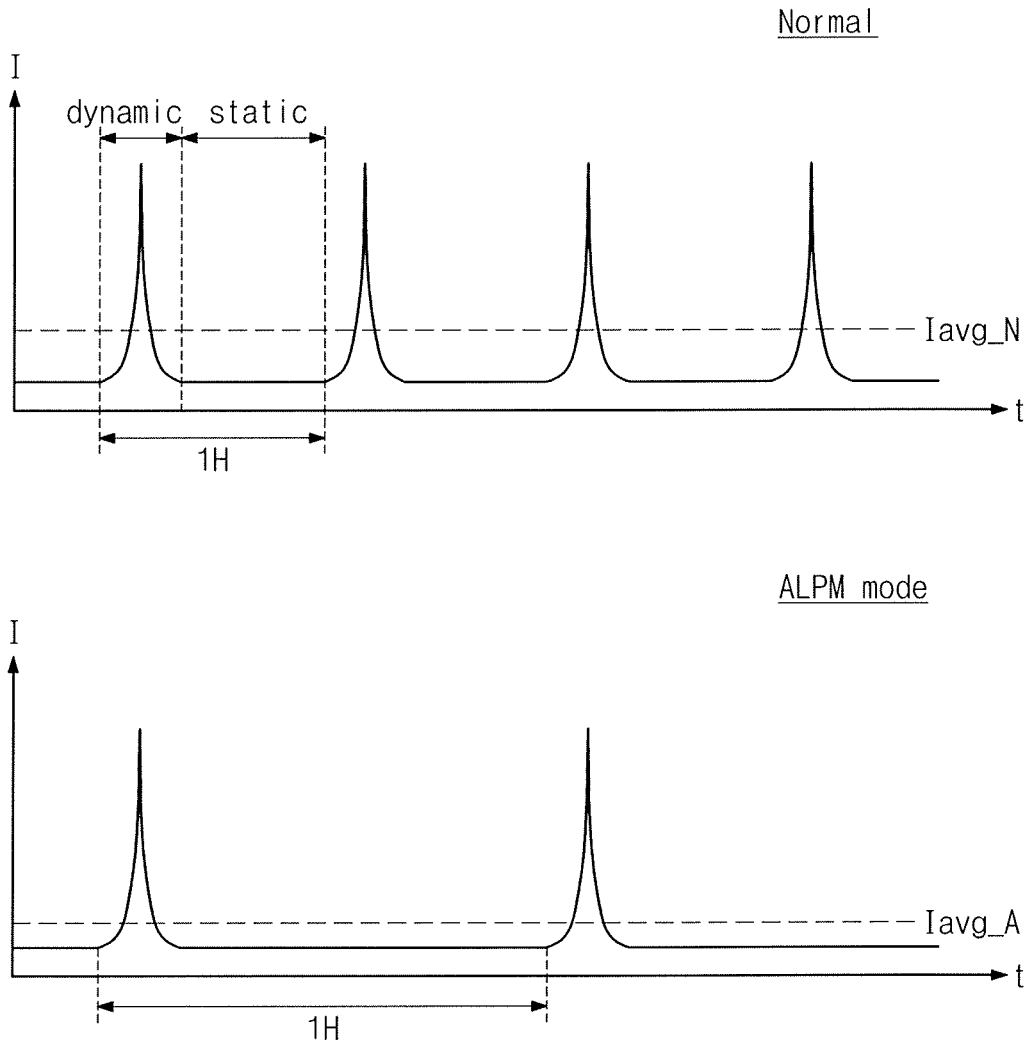
FIG. 4 is a graph illustrating a level of a current flowing through an output stage of a source amplifier when an operation frequency of a device according to an exemplary embodiment of the present inventive concept is reduced.

FIG. 4 is a graph illustrating a level of a current flowing through an output stage of a source amplifier 380-1 when an operation frequency of a device according to an exemplary embodiment of the present inventive concept is reduced. Referring to FIG. 4, a horizontal time period 1H represents a length of time during which a gate control signal is applied to one gate line. One horizontal time period 1H may include a dynamic period and a static period. During the dynamic period, the source amplifier 380-1 may generate a current to charge the capacitor Cap of the pixel PX. During the static period, which is, for example, subsequent to the dynamic period, the source amplifier 380-1 may consume power.

Assuming that when the device 1000 operates at a reference frequency (e.g., 60 Hz) in a normal power mode, an average value of a current flowing through an output stage of the source amplifier 380-1 is Iavg_N. When the device 1000 operates at a frequency of 30 Hz according to a request for a low power mode (e.g., ALPM mode) from a host, the horizontal time period 1H may become twice that in the normal power mode. Thus, an average value of the current flowing through the output stage of the source amplifier 380-1 may be reduced to half (e.g., ½Iavg_N) that in the normal power mode. Accordingly, when an operation frequency of the device 1000 is reduced, the dynamic period in which the capacitor Cap of the pixel PX is charged may increase, and thus, the power consumption of the device 1000 may be reduced.

Figure 5:
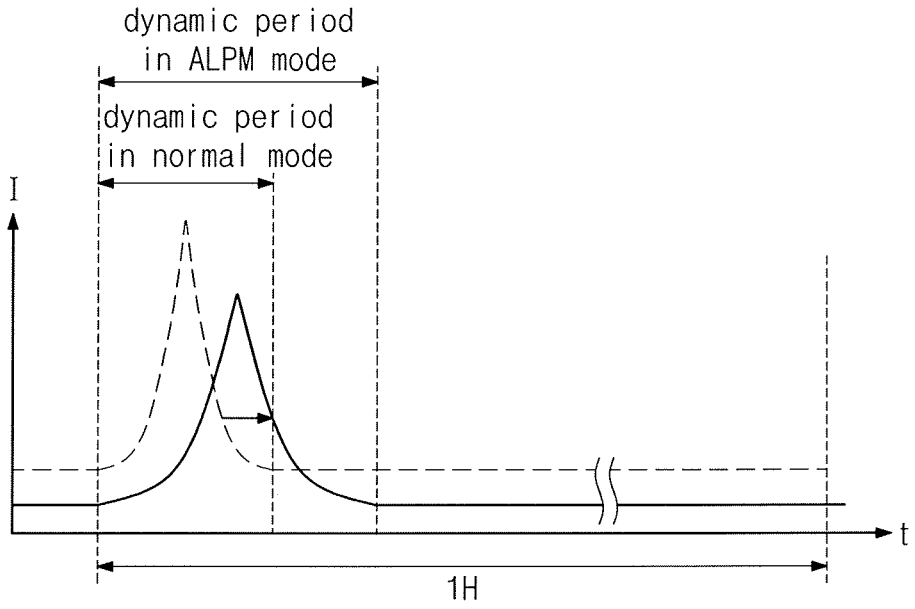
FIG. 5 is a graph illustrating a level of a bias current flowing through a source amplifier according to a mode in which a device according to an exemplary embodiment of the present inventive concept operates.

FIG. 5 is a graph illustrating levels of bias currents flowing through a source amplifier 380-1 according to a mode in which a device according to an exemplary embodiment of the present inventive concept operates. In FIG. 5, a dotted line represents an output current of the source amplifier 380-1 in a normal power mode and a solid line represents an output current of the source amplifier 380-1 in a low power mode.

Referring to FIGS. 3 and 5, the bias voltage Vbias applied to the source amplifier 380-1 may be controlled to reduce the power consumption of the device 1000 when the device 1000 operates in a low power mode. When the bias voltage Vbias applied to the source amplifier 380-1 is reduced, a bias current of the source amplifier 380-1 may be reduced overall. A dynamic period in which the capacitor Cap of the pixel PX is charged in the low power mode may be longer than that in the normal power mode. Thus, an amount of current flowing through the source amplifier 380-1 may be reduced in the low power mode, and thus, the power consumption of the source amplifier 380-1 may be reduced.

Unlike a low power mode (e.g., 8-color mode) in which 1 bit is output with respect to each of red, green and blue data in the low power mode, the device 1000 according to an exemplary embodiment of the present inventive concept can operate in a full-color mode even in a low power mode (e.g., ALPM mode).

Figure 6:
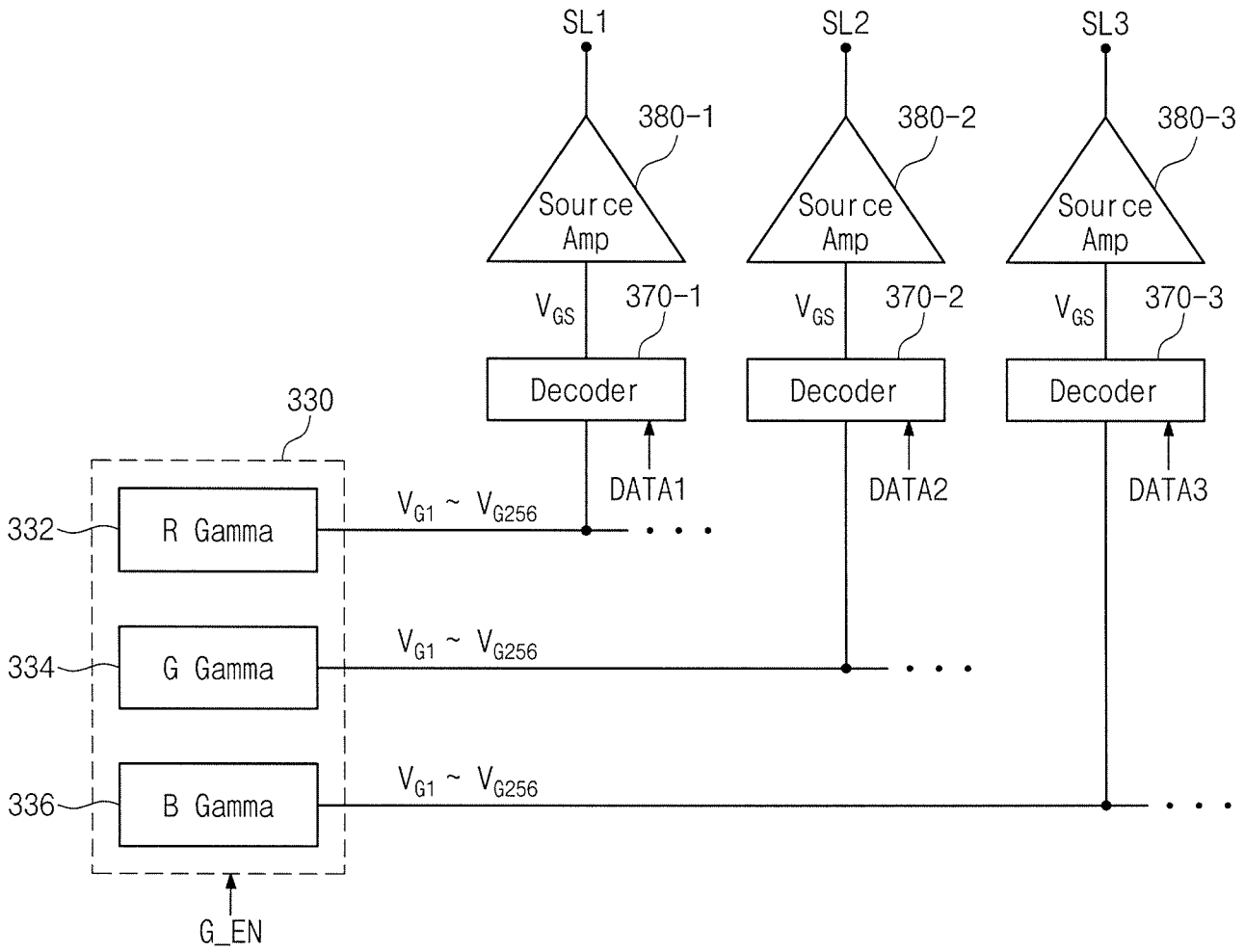
FIG. 6 is a block diagram illustrating a part of a source driver according to an exemplary embodiment of the present inventive concept.

FIG. 6 is a block diagram illustrating a part of a source driver according to an exemplary embodiment of the present inventive concept. A method of reducing the power consumption of the device 1000 by controlling the gamma voltage generation unit 330 is described below.

The gamma voltage generation unit 330 may include an R gamma voltage generation unit 332, a G gamma voltage generation unit 334, and a B gamma voltage generation unit 336 which correspond to a red color, R, a green color G, and a blue color B, respectively. The decoders 370-1~370-3 may be connected to the R gamma voltage generation unit 332, the G gamma voltage generation unit 334, and the B gamma voltage generation unit 336, respectively. Remaining decoders may be sequentially connected to a corresponding one of the R gamma voltage generation unit 332, the G gamma voltage generation unit 334, and the B gamma voltage generation unit 336. The gamma voltage generation unit 330 can generate gamma reference voltages $V_{G1}$~$V_{G256}$ in response to a gamma enable signal G_EN. The gamma voltage generation unit 330 can generate the gamma reference voltages $V_{G1}$~$V_{G256}$ in response to the gamma enable signal G_EN.

The decoder 370-1~370-3 can transform pixel data DATA1~DATA3 received from the second latch 360 into a data voltage (e.g., a gray scale voltage $V_{GS}$) using the gamma reference voltages $V_{G1}$~$V_{G256}$. The pixel data DATA1~DATA3 may correspond to the red color R, the green color G, and the blue color B of one pixel PX, respectively.

Source amplifiers 380-1~380-3 can be inputted with outputs of the decoders 370-1~370-3 to output data signals to source lines SL1~SL3, respectively. The data signals corresponding to the red color R, the green color G, and the blue color B, respectively, may be output through the source lines SL1~SL3, respectively.

To reduce the power consumption of the device 1000 in a low power mode, a part of the amplifiers in the gamma voltage generation unit 330 may be selectively turned on to generate a part of the plurality of gamma reference voltages $V_{G1}$~$V_{G256}$. In a low power mode, all the gamma reference voltages $V_{G1}$~$V_{G256}$ corresponding to 8 bits may not be used and a part of the gamma reference voltages $V_{G1}$~$V_{G256}$ can be used to transform the pixel data DATA into the data voltage.

Figure 7A:
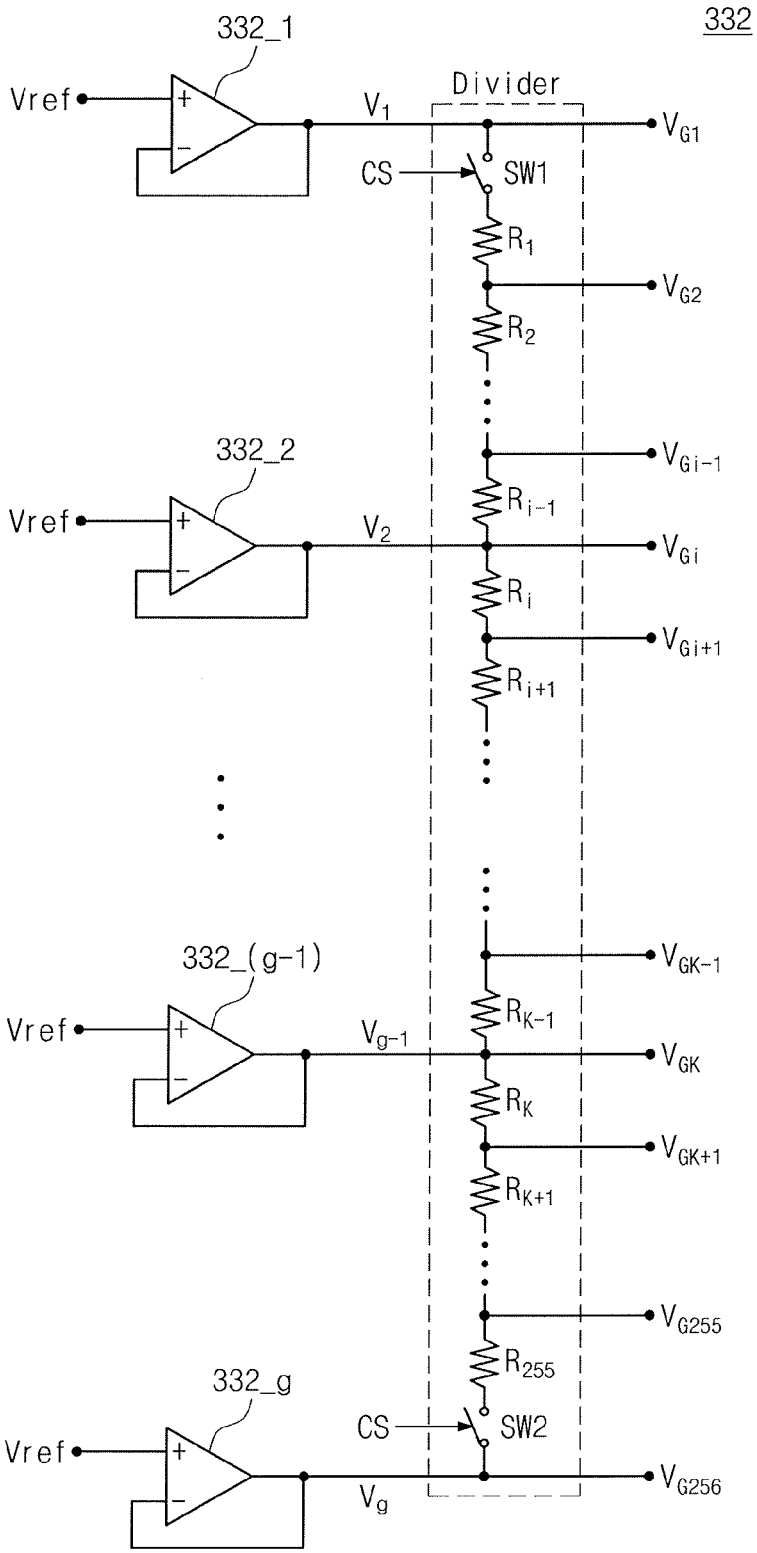
FIG. 7A is a block diagram illustrating a gamma voltage generation unit of FIG. 6 according to an exemplary embodiment of the present inventive concept.

FIG. 7A is a block diagram illustrating a gamma voltage generation unit of FIG. 6 according to an exemplary embodiment of the present inventive concept. The R gamma voltage generation unit 332 is illustrated as an example. Referring to FIG. 7A, the R gamma voltage generation unit 332 may include a plurality of amplifiers 332_1~332_g and a voltage divider which includes a plurality of resistors R1~R255 and switches SW1 and SW2.

The amplifiers 332_1~332_g can receive a reference voltage Vref from the outside thereof and output voltages V1~Vg, respectively. Although FIG. 7A illustrates that the same reference voltage Vref is applied to the amplifiers 332_1~332_g, the present inventive concept is not limited thereto, and different reference voltages from one another may be applied to the amplifiers 332_1~332_g. As illustrated in FIG. 7A, the resistors R1~R255 in the voltage divider may be connected to the amplifiers 332_1~332_g. The gamma reference voltages $V_{G1}$~$V_{G256}$ having different voltage levels from one another may be generated by controlling the reference voltage Vref or the bias voltage applied to the amplifiers 332_1~332_g. In a normal power mode, the switches SW1 and SW2 may be turned on to generate the gamma reference voltages $V_{G1}$~$V_{G256}$.

According to an exemplary embodiment of the present inventive concept, in a low power mode operation, in response to the gamma enable signal G_EN received from the control logic 310 of FIG. 2, the amplifiers 332_1 and 332_g may be turned on and the remaining amplifiers 332_2~332_g-1 may be turned off. In this case, the switches SW1 and SW2 may be turned off according to a control of a control signal CS. This is to prevent a current leakage through the resistors R1~R255 in a low power mode operation. Although an example of realizing the low power mode using the amplifier 332_1 that generates the gamma reference voltage $V_{G1}$ of the highest level and the amplifier 332_g that generates the gamma reference voltage $V_{G256}$ of the lowest level is described with reference to FIG. 7A, the present inventive concept is not limited thereto, and the low power mode may be realized in various ways.

Figure 7B:
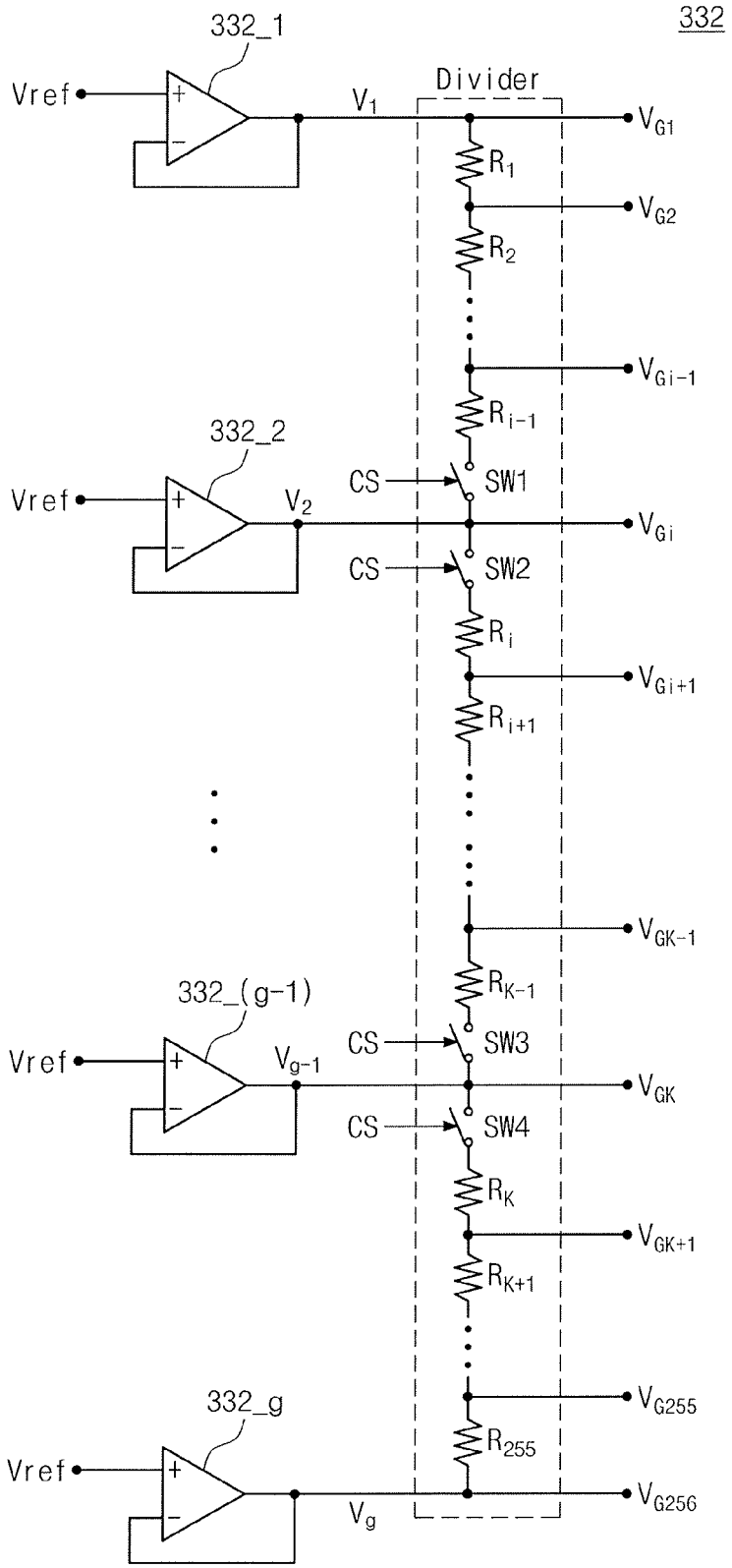
FIG. 7B is a block diagram illustrating a gamma voltage generation unit of FIG. 6 according to an exemplary embodiment of the present inventive concept.

FIG. 7B is a block diagram illustrating a gamma voltage generation unit of FIG. 6 according to an exemplary embodiment of the present inventive concept. Referring to FIG. 7B, a low power mode may be realized using the amplifier 332_2 that generates the gamma reference voltage $V_{Gi}$ and the amplifier 332_(g-1) that generates the gamma reference voltage $V_{GK}$.

Referring to FIG. 7B, the amplifiers 332_1 and 332_(g-1) are selected to realize a low power mode. Switches SW1~SW4 may be provided to prevent a current from leaking into other nodes except output nodes of the amplifiers 332_2 and 332_(g-1) as illustrated in FIG. 7B. In the low power mode operation, the switches SW1~SW4 may be turned off according to a control of the control signal CS. The remaining amplifiers 332_1, 332_3 to 332_(g-2), and 332_g except the amplifiers 332_2 and 332_g-1 may be turned off.

Figure 7C:
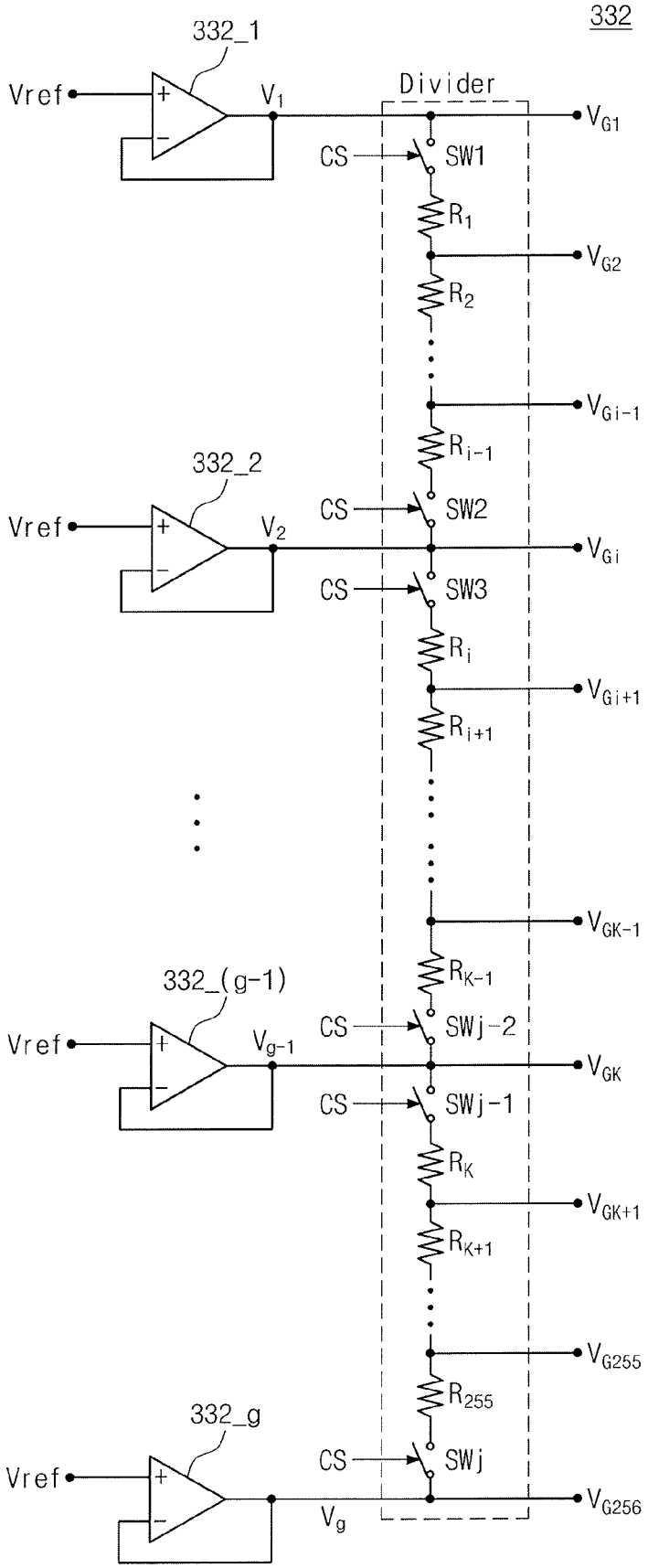
FIG. 7C is a block diagram illustrating a gamma voltage generation unit of FIG. 6 according to an exemplary embodiment of the present inventive concept.

FIG. 7C is a block diagram illustrating a gamma voltage generation unit according to an exemplary embodiment of the present inventive concept. A low power mode may be realized using arbitrarily selected two amplifiers among the amplifiers 332_1~332_g and switches SW1~SWj provided as illustrated in FIG. 7C. In this case, gamma reference voltages used in the low power mode may be arbitrarily selected from output voltages V1~Vg of the amplifiers 332_1~332_g. The number of the gamma reference voltages used in the low power mode may be arbitrarily selected. For example, a low power mode may be realized using equal to or more than three gamma reference voltages selected from the output voltages V1~Vg of the amplifiers 332_1~332_g.

The decoder 370-1 of FIG. 6 may arbitrarily select two gamma reference voltages (e.g., $V_{G1}$ and $V_{G256}$) among the gamma reference voltages $V_{G1}$~$V_{G256}$ and can transform the received pixel data DATA into a data voltage using the arbitrarily selected gamma reference voltages. Substantially the same operation may be performed on the G gamma voltage generation unit 334 and the B gamma voltage generation unit 336, and 1-bit data may be output with respect to the red color R, the green color G, and the blue color B (e.g., 8-color mode). Thus, the power consumption of the device 1000 may be reduced.

Figure 8A:
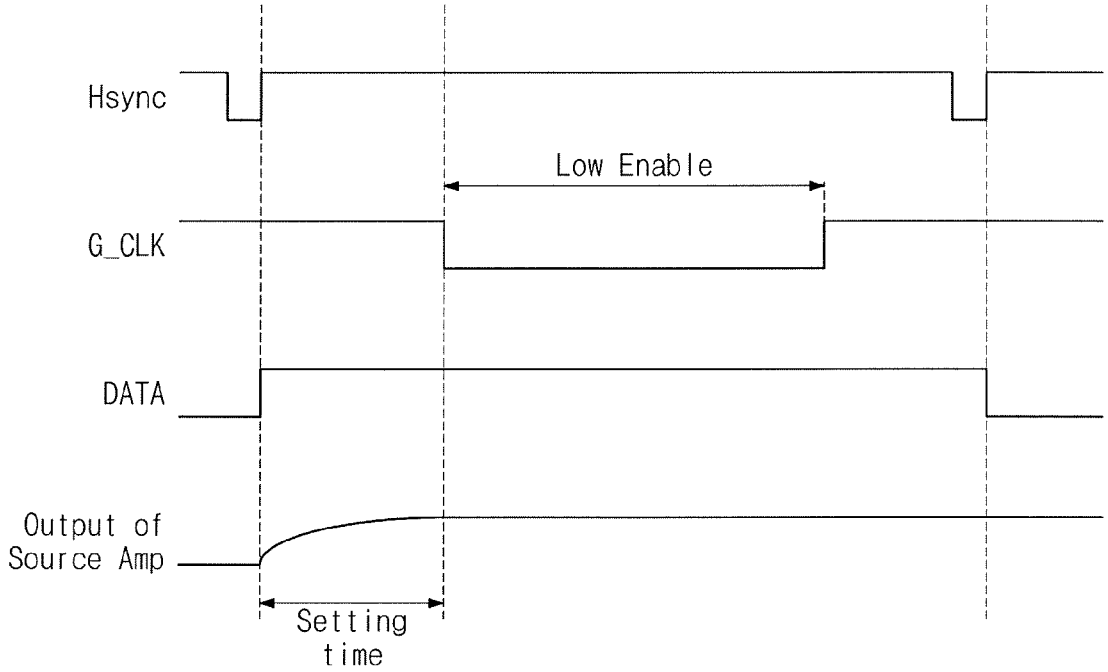
FIGS. 8A and 8B are graphs illustrating a method of reducing power consumption of a device by controlling a gate timing according to an exemplary embodiment of the present inventive concept.
Figure 8B:
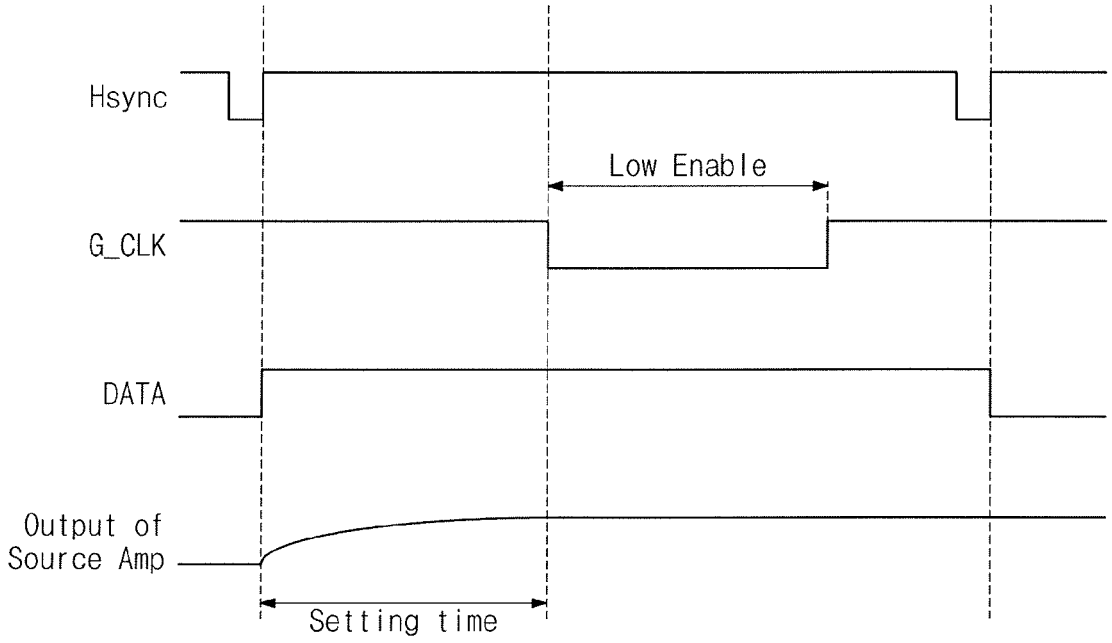

FIGS. 8A and 8B are graphs illustrating a method of reducing power consumption of a device by controlling a gate timing according to an exemplary embodiment of the present inventive concept.

Referring to FIGS. 8A and 8B, graphs of a horizontal synchronizing signal Hsync, a gate clock signal G_CLK, a parallelized data DATA, and an output signal of a source amplifier is illustrated. The gate clock signal G_CLK may be a gate control signal and can control a timing at which a gate line is driven. For example, the gate clock signal G_CLK may be a low enable signal, as shown in FIGS. 8A and 8B. The horizontal synchronizing signal Hsync, the gate clock signal G_CLK, and the parallelized data DATA are digital signals, and the output signal of the source amplifier is an analog signal.

As described above, a pixel PX of a display panel includes a capacitor Cap. Thus, a predetermined time (e.g., a settling time) may be taken for the capacitor Cap to be charged. To completely output data to a display panel, a capacitor Cap of the pixel PX may be completely charged before the gate clock signal G_CLK is enabled. For example, after the settling time has elapsed, the gate clock signal G_CLK may be enabled.

When a low power mode is requested from a host, the timing controller 100 of FIG. 1 can control a timing at which the gate clock signal G_CLK is enabled. For example, the timing at which the gate clock signal G_CLK is enabled in the low power mode may be further delayed compared with that in a normal power mode. When the timing at which the gate clock signal G_CLK is enabled is delayed, the settling time can be secured as much as the time by which the gate clock signal G_CLK is delayed. Since the settling timing increases, a time for charging the capacitor Cap of the pixel PX can be secured. For example, since the time for charging the capacitor Cap of the pixel PX can be secured as much as the delayed time of the gate clock signal G_CLK, a level of a bias voltage Vbias applied to the source amplifier may be reduced. Thus, power consumption of the device 1000 can be reduced by controlling not only a source driver but also a gate driver that controls the timing of the gate clock signal G_CLK.

Figure 9:
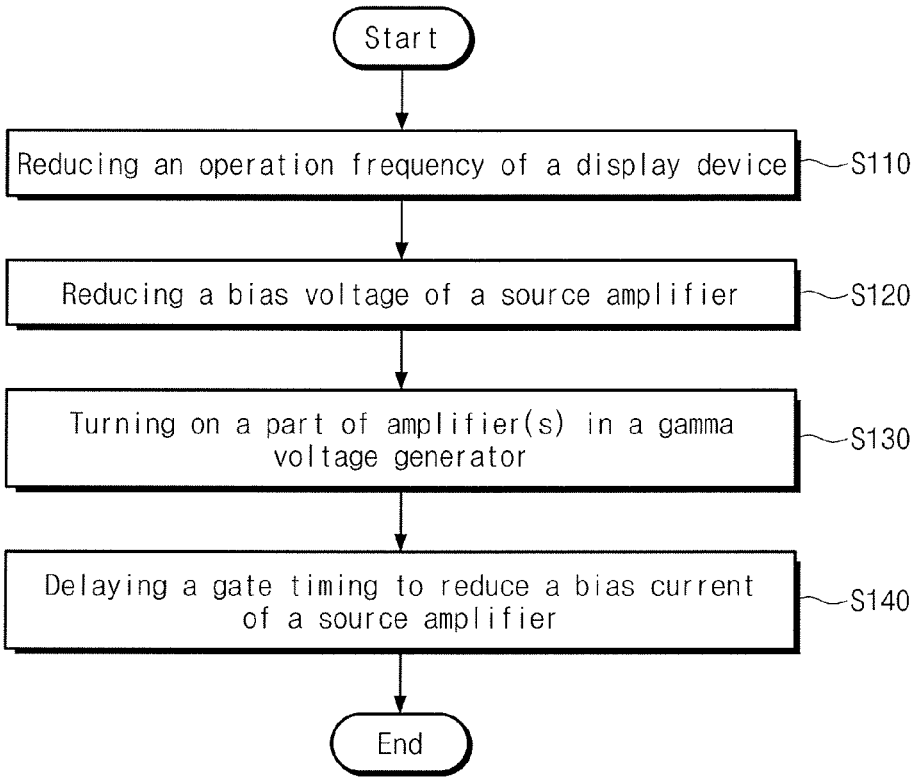
FIG. 9 is a flow chart illustrating a method of reducing power consumption of a device according to an exemplary embodiment of the present inventive concept.

FIG. 9 is a flow chart illustrating a method of reducing power consumption of a device according to an exemplary embodiment of the present inventive concept.

In a step S110, an operation frequency of the device 1000 is reduced. For example, when a first low power mode operation is requested from a host, the timing controller 100 of FIG. 1 can reduce an operation frequency of the device 1000, and thus, the power consumption of the device 1000 may be reduced. A settling time can be secured by delaying a timing at which a gate clock signal G_CLK is enabled.

In a step S120, a bias voltage applied to a source amplifier in an output buffer of a source driver is reduced. In addition to the step S110, a request for a second low power mode operation may be received from the host, and thus, the power consumption of the device 1000 may further be reduced. A bias current of the source driver can be reduced by reducing the bias voltage applied to the source driver. Data of a full-color may be output through the output buffer of the source driver by controlling the bias current of the source driver to reduce power consumption.

In a step S130, a part of amplifiers included in a gamma voltage generation unit is turned on. For example, in addition to the step S120, a request for a third low power mode operation may be received from the host, and thus, the power consumption of the device 1000 may further be reduced. The step S130 may be executed in substantially the same manner as that described with reference to FIGS. 6 and 7. According to the step S130, pixel data DATA can be transformed into a data voltage using two gamma reference voltages $V_{G1}$ and $V_{G256}$ among the gamma reference voltages $V_{G1}$~$V_{G256}$. Accordingly, the device 1000 may operate in an 8-color low power mode.

In a step S140, a gate timing at which a gate clock signal G_CLK is enabled is controlled. For example, in addition to the step S130, a request for a fourth low power mode operation may be received from the host, and thus, the power consumption of the device 1000 may further be reduced. The step S140 may be executed in substantially the same manner as that described with reference to FIGS. 8A and 8B. A settling time can be secured by delaying the gate timing at which the gate clock G_CLK is enabled. Since a time for charging the capacitor Cap of the pixel PX can be secured as much as the secured settling time, a level of the bias voltage Vbias applied to the source amplifier may be further reduced.

Although a step (e.g., step S140) of controlling the gate timing is illustrated in FIG. 9 as being executed at last, the present inventive concept is not limited thereto. For example, the step S140 of controlling the gate timing may be executed before the step S130 of turning on a part of the amplifiers in the gamma voltage generation unit.

Figure 10:
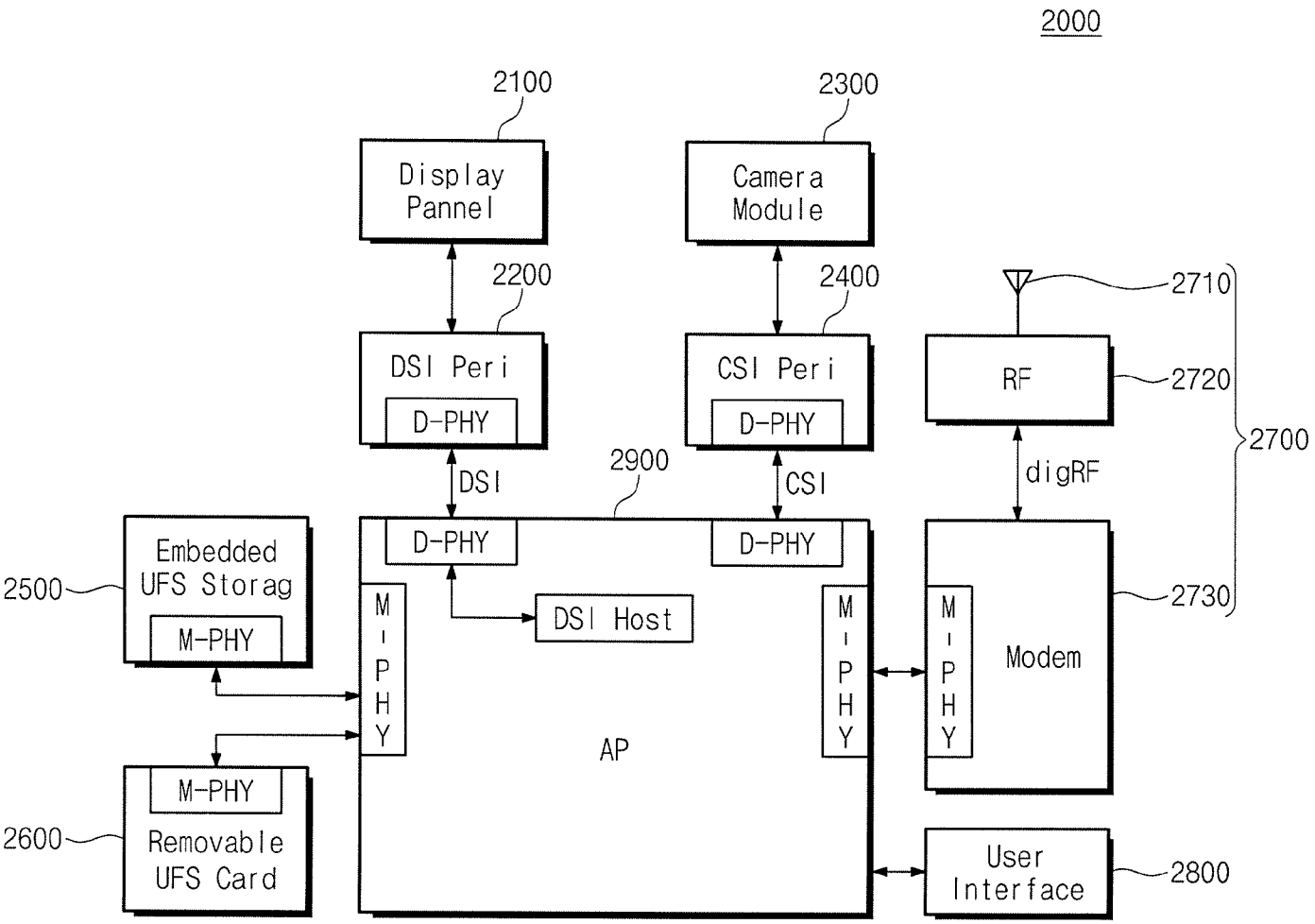
FIG. 10 is a block diagram illustrating a mobile device to which an exemplary embodiment of the present inventive concept is applied.

FIG. 10 is a block diagram illustrating a mobile device 2000 to which an exemplary embodiment of the present inventive concept is applied. Referring to FIG. 10, the mobile device 2000 may be configured to support a mobile industry processor interface (MIPI) standard or an embedded display port (eDP) standard. The mobile device 2000 may include a display panel 2100, a display serial interface (DSI) peripheral circuit 2200, a camera module 2300, a camera serial interface (CSI) peripheral circuit 2400, an embedded universal flash storage (UFS) storage 2500, a removable UFS card 2600, an wireless transmission/reception unit 2700, a user interface 2800, and an application processor 2900.

The display panel 2100 can display an image. The DSI peripheral circuit 2200 may include the timing controller 100, the source driver 300, the gate driver 200, etc. illustrated in FIG. 1. A DSI host embedded in the application processor 2900 can perform a serial communication with the display panel 2100 through a DSI.

When a request for a low DSI peripheral circuit 2200 occurs, the DSI peripheral circuit 2200 can reduce an operation frequency of the mobile device 2000, reduce a bias voltage applied to a source amplifier, selectively turn on at least one amplifier of a gamma voltage generation unit, and/or control a gate timing of a gate driver. Those operations may be separately performed or sequentially performed according to a request from the DSI host. Thus, power consumption of the mobile device 2000 may be reduced.

The camera module 2300 and the CSI peripheral circuit 2400 may include a lens, an image sensor, an image processor, etc. Image data generated from the camera module 2300 may be processed in an image processor and the processed image data may be transferred to the application processor 2900 through a camera serial interface (CSI).

The embedded UFS storage 2500 and the removable UFS card 2600 can perform a communication with the application processor 2900 through an M-PHY layer. The host (e.g., the application process 2900) may include a bridge to communicate with the removable UFS card 2600 by protocols other than a UFS protocol. The application process 2900 and the removable UFS card 2600 can communicate with each other by various card protocols (e.g., a universal serial bus flash driver (UFD), a multimedia card (MMC), an embedded MMC secure digital (eMMC SD), a mini SD, a micro SD, etc.).

The wireless transmission/reception unit 2700 may include an antenna 2710, a radio frequency (RF) unit 2720, and a modem 2730. Although the modem 2730 is illustrated to communicate with the application processor 2900 through the M-PHY layer in FIG. 10, the present inventive concept is not limited thereto, and the modem 2730 may be embedded in the application processor 2900 in an exemplary embodiment of the present inventive concept.

According to an exemplary embodiment of the present inventive concept, power consumption of a mobile device including a display device may be reduced.

Although a few exemplary embodiments of the present inventive concept have been described, it will be understood that various changes in form and detail may be made therein without departing from the spirit and scope of the present inventive concept as defined by the appended claims.

What is claimed is:

1. A display driver comprising:

a. gamma voltage generation unit configured to generate a plurality of gamma reference voltages having different voltage levels from one another in response to a gamma enable signal;

a decoder configured to transform pixel data corresponding to received image information into data voltages using the plurality of gamma reference voltages; and a plurality of source amplifiers configured to output the data voltages to a display panel, wherein the gamma voltage generation unit comprises:

a plurality of amplifiers; and a voltage divider comprising a plurality of resistors and a plurality of switches, wherein a first switch is connected to a first amplifier and a second switch is connected to a second amplifier, in normal power mode, the first and second switches are turned on to generate the plurality of gamma reference voltages, and in a low power mode, the first and second amplifiers are turned on, remaining amplifiers of the plurality of amplifiers are turned off, and the first and second switches are turned off such that gamma reference voltages of the first and second amplifiers are generated and gamma reference voltages of the remaining amplifiers are not generated.

2. The display driver of claim 1, wherein the plurality of amplifiers each receives a reference voltage.

3. The display driver of claim 1, wherein the first and second amplifiers are turned on and the remaining amplifiers are turned off in response to the gamma enable signal, and the first and second switches are turned on in response to a control signal.

4. The display driver of claim 1, further comprising a control logic configured to control a level of a bias voltage applied to at least one of the source amplifiers in the low power mode.

5. The display driver of claim 1, wherein in the low power mode, an operation frequency of the display driver is below a reference frequency.

6. A display device comprising:

a display panel including a plurality of pixels disposed where source lines and gate lines cross one another; and a display driver configured to provide data voltages generated based on received image information to the display panel, wherein the display driver comprises:

a gamma voltage generation unit configured to generate a plurality of gamma reference voltages having different voltage levels from one another in response to a gamma enable signal;

a decoder configured to transform pixel data corresponding to the image information into the data voltages using the plurality of gamma reference voltages; and a plurality of source amplifiers configured to output the data voltages to the display panel, wherein the gamma voltage generation unit comprises:

a plurality of amplifiers; and a voltage divider comprising a plurality of resistors and a plurality of switches, wherein a first switch is connected to a first amplifier and a second switch is connected to a second amplifier, in a normal power mode, the first and second switches are turned on to generate the plurality of gamma reference voltages, and in at least one of a plurality of low power modes, the first and second amplifiers are turned on, remaining amplifiers of the plurality of amplifiers are turned of, and the first and second switches are turned off such that gamma reference voltages of the first and second amplifiers are generated and gamma references voltages of the remaining amplifiers are not generated.

7. The display device of claim 6, wherein the plurality of amplifiers each receives a reference voltage.

8. The display device of claim 6, further comprising:

a timing controller configured to receive the image information to provide the received image information to the display driver, and to reduce an operation frequency of the display device below a reference frequency in a first low power mode; and a gate driver configured to drive the gate lines.

9. The display device of claim 8, further comprising a control logic configured to control a level of a bias voltage applied to at least one of the source amplifiers in a second low power mode.

10. The display device of claim 9, wherein in a third low power mode, the first switch and the second switch electrically cut the output voltages of the first and second amplifiers.

11. The display device of claim 9, wherein in a fourth low power mode, the remaining amplifiers are turned off while the first and second amplifiers are turned on.

12. The display device of claim 9, wherein in a fifth low power mode, the timing controller delays a timing at which a gate control signal is enabled by a reference time.

* * * * *